United States Patent [19]

Jenkins

[11] 4,172,684

[45] Oct. 30, 1979

[54] FLOOR LEVEL PIPE HANDLING APPARATUS

[75] Inventor: Cecil Jenkins, Tulsa, Okla.

[73] Assignee: Lee C. Moore Corporation, Tulsa, Okla.

[21] Appl. No.: 873,474

[22] Filed: Jan. 30, 1978

[51] Int. Cl.[2] ..... E21B 19/14

[52] U.S. Cl. ..... 414/22; 175/85; 414/745

[58] Field of Search ..... 214/1 BD, 2.5, 3, 1 P, 214/130 R, 148; 175/52, 85, 161

[56] References Cited

U.S. PATENT DOCUMENTS

| | | | |
|---|---|---|---|
| 1,812,351 | 6/1931 | Marsh | 214/2.5 |
| 1,884,874 | 10/1932 | Ross | 175/85 X |
| 2,690,847 | 10/1954 | Crookston | 214/2.5 |
| 3,144,135 | 8/1964 | Brown | 214/3 X |
| 3,533,516 | 10/1970 | Guier | 214/2.5 |
| 3,613,905 | 10/1971 | Woolslayer et al. | 214/2.5 |
| 3,633,771 | 1/1972 | Woolslayer et al. | 214/1 BD X |
| 4,117,941 | 10/1978 | McCleskey et al. | 214/2.5 |

*Primary Examiner*—L. J. Paperner

*Attorney, Agent, or Firm*—Brown, Flick & Peckham

[57] ABSTRACT

Mounted on the floor of an oil well derrick substructure is a support that is rockable on an axis perpendicular to the centerline of a well being drilled beneath the substructure. One end of an arm is pivotally mounted on the support on an axis transverse to the first mentioned axis, while the opposite end of the arm carries a pair of shoes having laterally opening pipe-receiving seats facing away from the arm. The free end of the arm can be swung toward and away from the well centerline and the arm support can be rocked to swing the arm laterally.

6 Claims, 5 Drawing Figures

FLOOR LEVEL PIPE HANDLING APPARATUS

In pulling drill pipe from a well, the pipe is suspended from the travelling block in the derrick or mast and a stand of pipe is unscrewed from the pipe still in the well. To rack the suspended pipe stand, its lower end is first moved out over the setback area on the substructure and then set down in the desired location. The upper end of the stand then is disconnected from the elevators and swung out into the proper place in the racking platform projecting from a side of the derrick. Both of these operations are often done manually, which requires considerable physical effort. The same procedure is used in racking drill collars.

It is an object of this invention to provide apparatus for mechanically moving the lower end of a suspended pipe stand or drill collar away from the centerline of a well and into the setback area. Other objects are to provide such apparatus which is of simple and inexpensive construction, and which can easily be manipulated to locate the pipe in the desired position on the setback.

The preferred embodiment of the invention is illustrated in the accompanying drawings, in which FIG. 1 is a side view;

Figure 1:
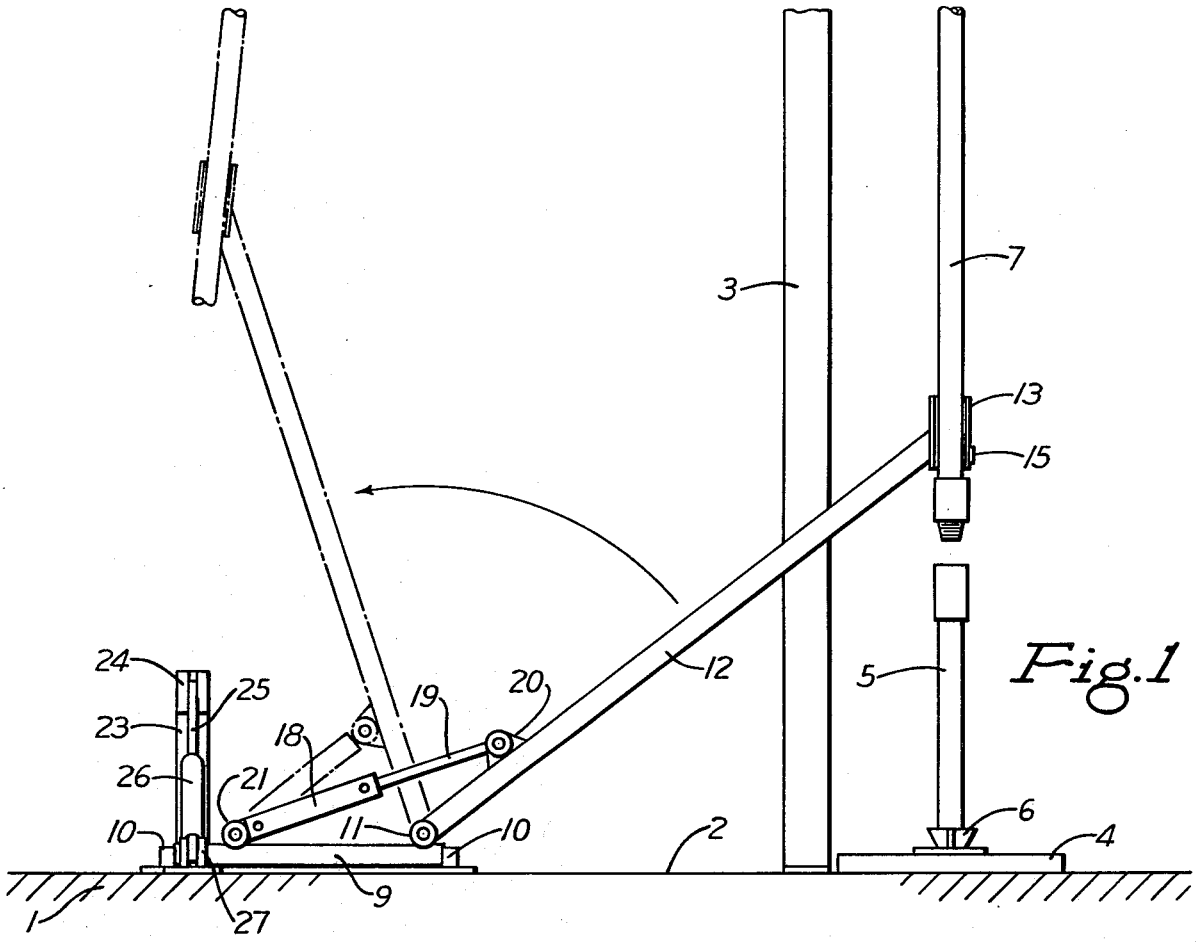
Figure 2:
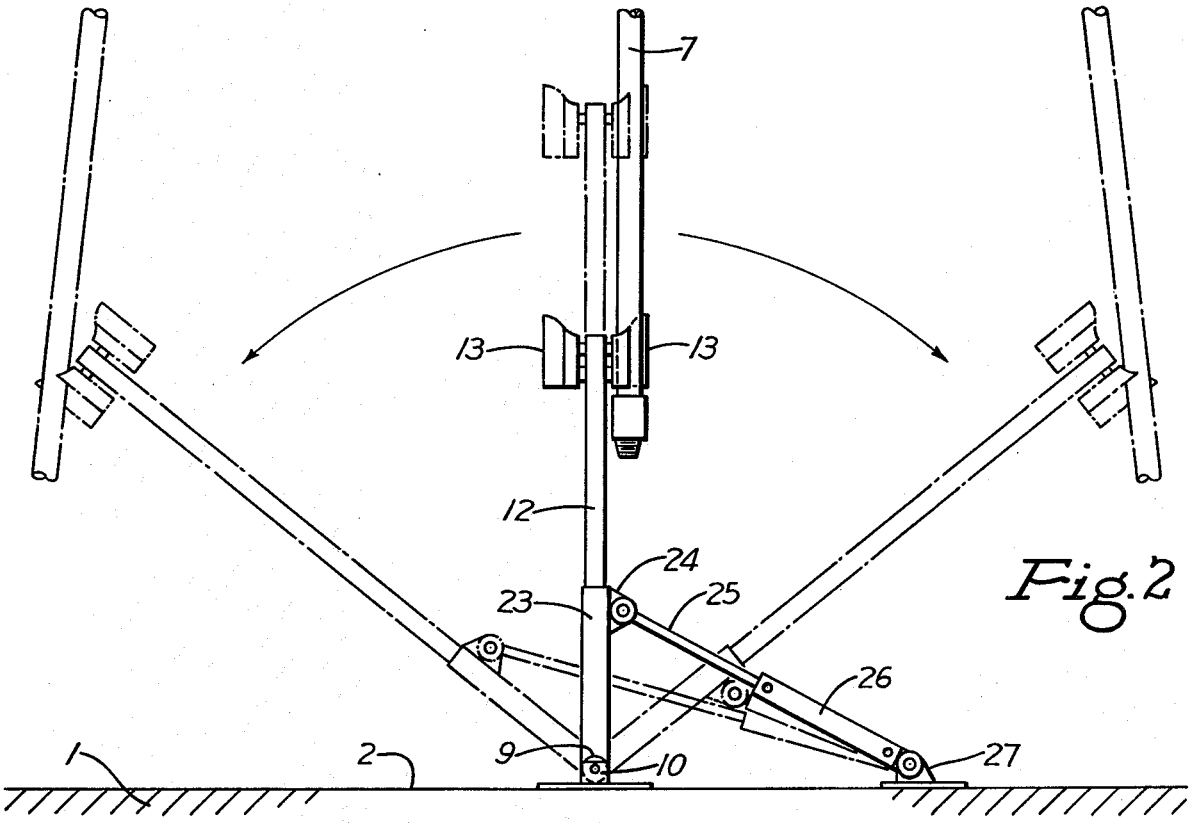
FIG. 2 is a front view.

Referring to FIGS. 1 and 2 of the drawings, a substructure 1 with a working floor 2 supports an oil well derrick or mast, only one of the front legs 3 of which are shown. The substructure also supports the usual rotary table 4, in which drill pipe 5 in the well is shown supported by slips 6 while a disconnected stand of pipe 7 above it is suspended from a traveling block (not shown). The floor of the substructure in front of the mast forms a setback area, which may be divided into two laterally spaced setback areas, for supporting pipe held in a pipe rack (not shown) projecting from the mast a considerable distance above the setback.

Figure 3:
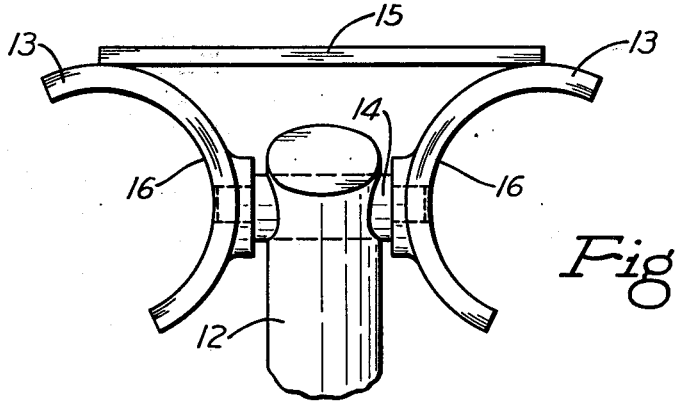
FIG. 3 is a plan view of the seats for pipes.
Figure 4:
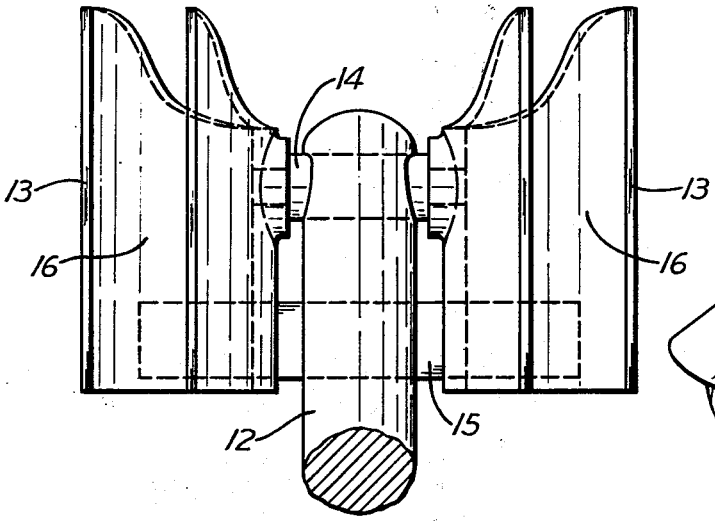
FIG. 4 is a front view of the seats.

Mounted on the floor between the two setback areas is a support 9, preferably in the form of a horizontal shaft, the ends of which are mounted in bearings 10 secured to the floor. The axis of the shaft is substantially perpendicular to the centerline of the well; that is, to pipe 5. Rigidly mounted on the inner or mast end of the shaft is a bracket 11, in which the lower end of an arm 12 is pivotally mounted on a transverse axis. The opposite or free end of the arm carries a pair of shoes 13, one on each side of it. The shoes are mounted on the end of a pivot pin 14 (FIGS. 3 and 4) extending transversely through the arm so that the shoes can turn in vertical planes parallel to the arm. The two shoes are rigidly connectecd by a cross bar 15. As shown in FIG. 3, each shoe has a laterally opening pipe-receiving seat 16 that faces away from the arm . The seat preferably is substantially semi-cylindrical so that it can extend about half way around a drill pipe or drill collar. Also, the seats are turned slightly toward the opposite end of the arm by locating pivot pin 14 closer to the edge of each shoe nearest shaft 9 than to the opposite edge of the shoe.

Means are provided for swinging the free end of the arm toward and away from the centerline of the well. Preferably, such means consist of a fluid pressure cylinder 18 from which a piston rod 19 extends. The outer end of the rod is pivotally mounted in a bracket 20 secured to the top of the lower portion of the arm. The opposite end of the cylinder is pivotally mounted in a similar manner in a bracket 21 secured to the supporting shaft 9. Any well known manually controlled means can be used for delivering fluid under pressure to either end of the cylinder to swing the arm.

For rocking shaft 9 in either direction, the lower end of a post 23 is rigidly mounted on the outer end of the shaft. At one side of the upper end of the post there is a bracket 24 in which the outer end of a piston rod 25 is pivotally mounted. The rod extends into a fluid pressure cylinder 26, the lower end of which is pivotally mounted in a bracket 27 secured to the floor of the substructure. This cylinder can be operated in the same way as the other cylinder.

OPERATION

In using this apparatus to set back the lower end of a stand of pipe suspended in the mast, fluid pressure is admitted to the outer end of the arm cylinder 18 to cause its free end to move toward the pipe. At the same time, fluid pressure is delivered to one end of the post cylinder 26 in order to swing the arm laterally far enough to enable shoes 13 to be moved into a position at one side of the suspended pipe stand. Then the arm is swung laterally in the opposite direction far enough for the shoe that is between it and the pipe to engage the pipe; i.e., for the pipe to be seated in the shoe as shown in FIG. 2. The arm cylinder now is reversed, which will swing the arm and shoes outwardly between the front legs of the mast and thereby swing the lower end of the pipe out over the space between the setback areas of the substructure floor as shown in FIG. 1. Then the post cylinder 26 is activated to swing the arm sideways in the direction in which the pipe-engaging shoe will push the lower end of the pipe over to the desired location above one of the setback areas. This location is indicated by dotted lines at the right-hand side of FIG. 2. When this location is reached, the pipe stand is lowered by the traveling block until the pipe rests of the floor of the substructure. The upper end of the pipe stand then is disconnected from the elevators and moved out into the pipe rack. Arm 12 then can be swung back into the mast to engage the next stand of pipe that is pulled from the well.

Figure 5:
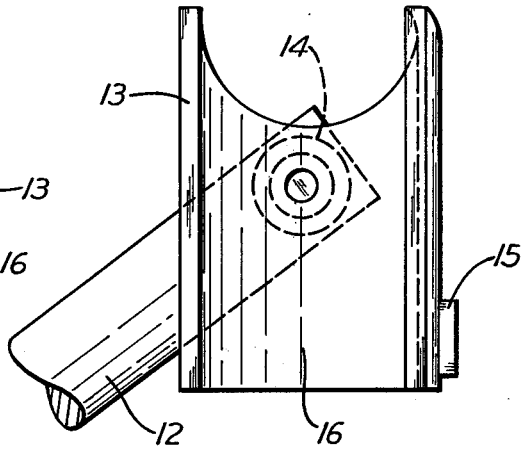
FIG. 5 is a side view of one of the seats.

The pipe-receiving shoes can rotate in planes parallel to their supporting arm so that they will stay in alignment with a pipe while the arm is swinging it away fron the centerline of the well. By pivoting the shoes above their center of gravity, they will always stay vertical when not engaging a pipe. In order to keep sufficient contact between a shoe and the drill pipe when the arm is swung into a laterally inclined position as shown in dotted lines at the sides of FIG. 2, the upper end of each shoe is inclined downwardly toward arm 12 as will be apparent in FIGS. 4 and 5.

The pipe handling apparatus disclosed herein makes it possible to avoid manual labor in setting back the lower ends of pipes and returning them from setback position to the inside of the mast. The apparatus is simple in construction and easy to operate.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. In combination with an oil well derrick substructure having a floor, apparatus for handling the lower end of drill pipe suspended above the floor on the centerline of a well being drilled beneath the substructure, said apparatus comprising a support mounted on said floor and rockable on an axis substantially perpendicular to said centerline, an arm, means pivotally mounting one end of the arm on said support on an axis transverse to said first-mentioned axis, means for swinging the opposite end of the arm toward and away from said centerline, means for rocking said support to swing the arm laterally over said floor, a shoe at one side of said opposite end of the arm, and means pivotally connecting the shoe to the arm on a transverse axis, the arm sloping upwardly from said support toward said centerline when the shoe is beside the centerline, and the shoe having a laterally opening pipe-receiving seat facing away from the arm, whereby when the shoe is swung by the arm away from said centerline with a suspended drill pipe in said seat the lower end of the pipe will likewise be swung away from said centerline.

2. In the combination recited in claim 1, said swinging means including a post extending upwardly from said rockable support, and fluid pressure cylinders operatively connected with said arm and post.

3. In the combination recited in claim 1, said rockable support including a horizontal shaft and bearings for the shaft mounted on said floor, and said swinging means including a post extending upwardly from said shaft, and a pair of fluid pressure cylinders, one of said cylinders being pivotally connected to said shaft and operatively connected with said arm, and the other cylinder being pivotally connected to said floor and operatively connected with said post.

4. In the combination recited in claim 1, said shoe being substantially semi-cylindrical to extend about half way around a pipe, and said transverse axis for the shoe being disposed closer to the edge of the shoe nearest said rockable support than to the opposite edge of the shoe.

5. In the combination recited in claim 1, the upper end of said shoe being inclined toward said arm.

6. In the combination recited in claim 1, a second shoe at the opposite side of said arm provided with a laterally opening pipe-receiving seat facing away from the arm, said second shoe being pivotally connected to the arm on the same transverse axis as the first-mentioned shoe.

* * * * *